US007340804B2

(12) United States Patent
Saderholm et al.

(10) Patent No.: US 7,340,804 B2
(45) Date of Patent: Mar. 11, 2008

(54) STRAP ASSEMBLY CAPABLE OF ROTATIONAL ENGAGEMENT WITH AN OBJECT, AND METHOD OF MANUFACTURING SAME

(75) Inventors: Davin Saderholm, Mission Viejo, CA (US); Robert Radi, Los Angeles, CA (US)

(73) Assignee: Arena Industries, LLC, Irvine, CA (US)

( * ) Notice: Subject to any disclaimer, the term of this patent is extended or adjusted under 35 U.S.C. 154(b) by 181 days.

(21) Appl. No.: 11/139,821

(22) Filed: May 27, 2005

(65) Prior Publication Data

US 2006/0265845 A1 Nov. 30, 2006

(51) Int. Cl.
*A44B 11/00* (2006.01)

(52) U.S. Cl. ..... 24/265 BC; 24/265 EC; 2/426; 2/450

(58) Field of Classification Search ..... None
See application file for complete search history.

(56) References Cited

U.S. PATENT DOCUMENTS 240,670 A * 4/1881 Davidson ..... 24/265 H
4,993,127 A * 2/1991 Mechem et al. ..... 24/701
D362,710 S * 9/1995 Hambrick ..... D22/136
6,080,922 A * 6/2000 Dimbath ..... 84/327
6,341,383 B1 * 1/2002 Beltrani ..... 2/452

* cited by examiner

*Primary Examiner*—Jack W. Lavinder
(74) *Attorney, Agent, or Firm*—Pepper Hamilton LLP

(57) ABSTRACT

A strap assembly capable of engagement with an object (101) includes a strap (110) having a first end (111) and a second end (112), and further includes a buckle (120, 190) coupled to the strap. The buckle includes a cover (210) and a base (220) adjacent to the cover, and the base includes a slot (221) and an engagement aperture (122). The object with which the strap assembly is engaged has coupled thereto an attachment piece (102), which may take the form of a post (141) topped with a cap (142). The strap extends through the slot, the engagement aperture is capable of engaging the attachment piece, and the buckle is capable of rotating about the attachment piece when the engagement aperture is engaged with the attachment piece.

24 Claims, 5 Drawing Sheets

FIG. 1

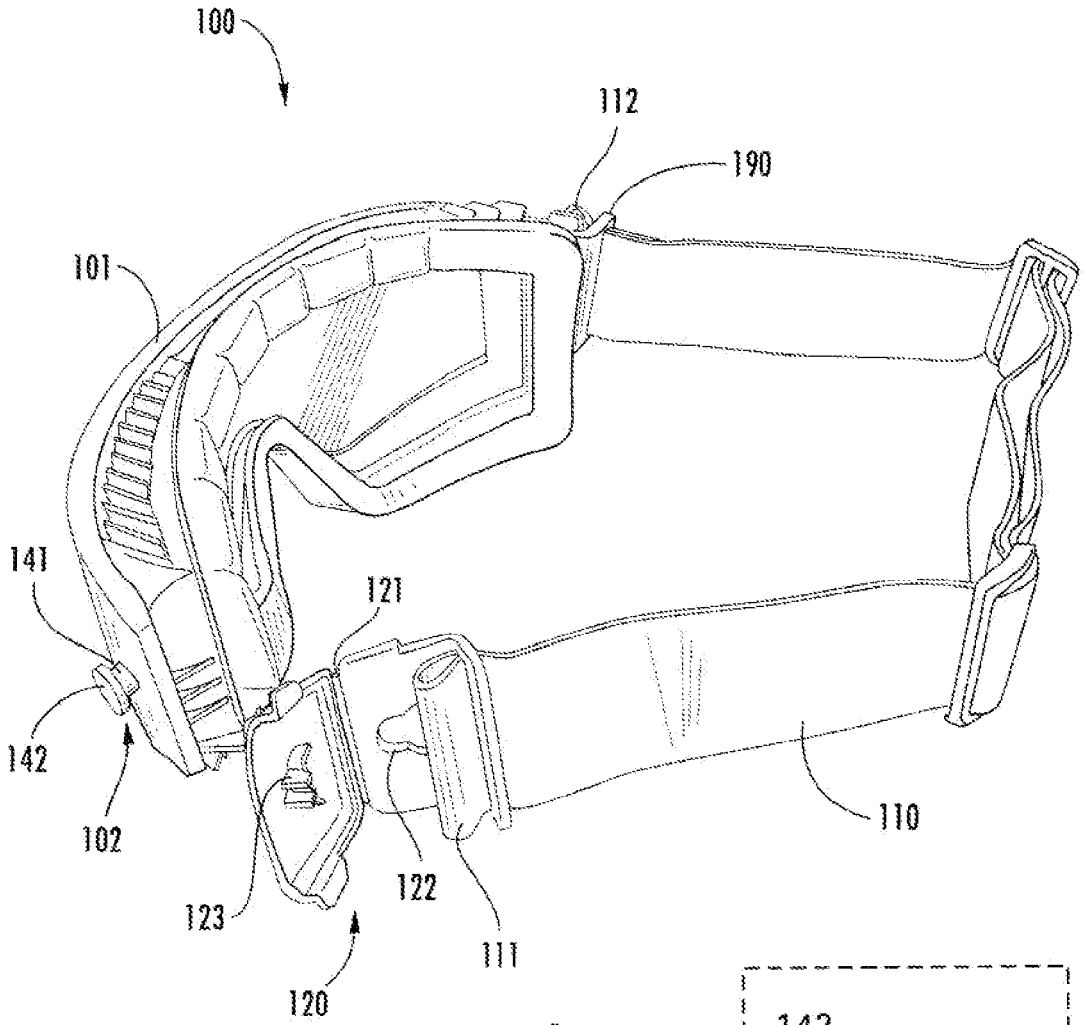
FIG. 1
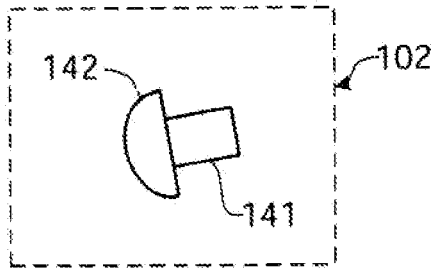

STRAP ASSEMBLY CAPABLE OF ROTATIONAL ENGAGEMENT WITH AN OBJECT, AND METHOD OF MANUFACTURING SAME

FIELD OF THE INVENTION

This invention relates generally to strap assemblies for various objects, and relates more particularly to a strap assembly capable of rotating with respect to the object.

BACKGROUND OF THE INVENTION

Wearable protective gear such as helmets and goggles are often fitted with straps that serve to hold the protective gear in place on the body. Similar straps serve as handles on luggage, briefcases, or other items intended to be carried or manipulated by hand. The manner in which such straps are connected to and interact with the foregoing and similar items determines to a large degree how comfortable the items are, and how easy they are to use. Existing straps for carrying an object or for retaining an object on the body are connected to the object rigidly and permanently. Such rigid and permanent connections tend to be fairly secure and long-lasting but also tend to make the object uncomfortable, hard to use, and/or difficult to repair. Accordingly, there exists a need for a strap assembly that is easily attached to and removed from an object and that promotes comfort and ease of use by providing a rotatable connection.

BRIEF DESCRIPTION OF THE DRAWINGS

The invention will be better understood from a reading of the following detailed description, taken in conjunction with the accompanying figures in the drawings in which:

FIG. 1 is a perspective view of a strap assembly attached to an object according to an embodiment of the invention;

Figure 2:
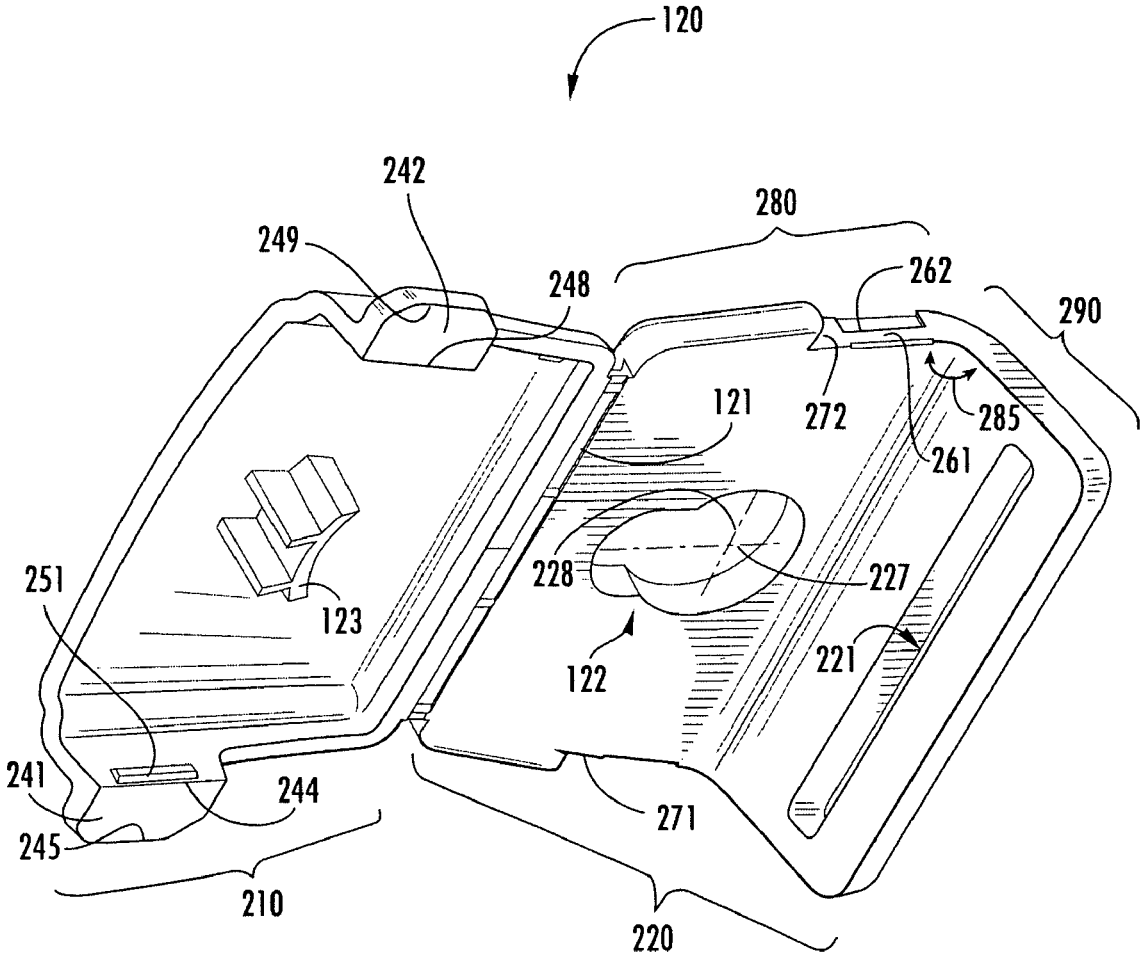
FIG. 2 is a perspective view of a buckle in an open configuration and forming part of a strap assembly according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, a strap assembly capable of engagement with an object comprises a strap having a first end and a second end, and further comprises a buckle coupled to the strap. The buckle comprises a cover and a base adjacent to the cover, and the base comprises a slot and an engagement aperture. The strap extends through the slot. The object with which the strap assembly is engaged has coupled thereto an attachment piece, which may take the form of a post topped with a cap. The engagement aperture is capable of engaging the attachment piece and is also easily disengagble from the attachment piece, thus facilitating, for example, the substitution of one buckle for another, as when a buckle is damaged. The buckle is capable of rotating about the attachment piece when the engagement aperture is engaged with the attachment piece. This rotational capability enables the strap to self-adjust, thereby greatly enhancing the comfort and ease of use associated with the wearing, handling, or other manipulation of or interaction with the object.

Referring now to the figures, FIG. 1 is a perspective view of a strap assembly 100 according to an embodiment of the invention. FIG. 1 also depicts an object 101 having an attachment piece 102 coupled thereto to which strap assembly 100 is attached. In the illustrated embodiment, object 101 is a facemask portion of a pair of goggles, but the object to which strap assembly 100 is attached according to an embodiment of the invention could also be a different form of eyewear, a helmet, a backpack, or any similar item having a strap that may be worn on the body. Additionally, object 101 could be a suitcase, a briefcase, a bag, or the like having a strap or handle. Strap assembly 100 comprises a strap 110 and a buckle 120 coupled to strap 110. In at least one embodiment, strap 110 is an elastic strap capable of stretching and expanding and of then returning to its relaxed state without permanent deformation.

Strap 110 has an end 111 and an opposing end 112. Buckle 120 is attached to end 111, while end 112 is attached to a buckle 190. The manner of such attachment will be explained below. As will also be further explained below, buckle 120 and buckle 190 are symmetric and interchangeable. Accordingly, although buckle 120 is the only buckle that is described in detail in the following discussion, such discussion should be understood to apply equally to buckle 190, unless otherwise indicated, and buckles 120 and 190 each interact with object 101 in the same or a similar manner, which manner will be described below. Buckle 120 further comprises a hinge 121, an engagement aperture 122, and a locking extension 123, each of which will be further described and discussed in connection with subsequent figures.

Attachment piece 102, as it is illustrated in FIG. 1, comprises a post 141 and a cap 142. Post 141 has a first diameter and cap 142 has a second diameter. The first diameter is smaller than the second diameter. In the embodiment of the strap assembly 100 illustrated in FIG. 1, the cap 142 is flat or substantially flat. According to other embodiments, as shown for example in the small detail in the lower right-hand corner of FIG. 1, cap 142 is spherical or substantially spherical, and has the same diameter (referred to above as the second diameter) that it has in the rated embodiment of the strap assembly 100 illustrated in FIG. 1. As it is used herein, the word "cap" encompasses any kind of top on post 141, whether fiat, spherical, or any other shape. In one embodiment, another attachment piece, similar to attachment piece 102 and for attaching to buckle 190, is located at an opposite side of object 101.

A spherical cap 142 introduces an additional degree of freedom to buckle 120, such that buckle 120 may not only rotate about post 141, but may also rotate about an axis perpendicular to post 141. The result is that buckle 120 may adjust itself or be moved to almost any desired position.

FIG. 2 is a perspective view of buckle 120 according to an embodiment of the invention. As illustrated in FIG. 2, buckle 120 is a unitary structure comprising a cover 210 and a base 220 adjacent to cover 210. Base 220 comprises a slot 221 and engagement aperture 122. As may be seen in FIG. 1, strap 110 extends through slot 221, and engagement aperture 122 is capable of engaging attachment piece 102 such that buckle 120 and strap assembly 100 engage object 101.

The nature of engagement aperture 122, which nature will be described in more detail below, is such that buckle 120 is capable of rotating through 360 degrees about attachment piece 102 when engagement aperture 122 is engaged with attachment piece 102. This rotational capability allows strap 110 to maneuver freely and adjust itself according to changing conditions, and is a feature, among other features, that sets strap assembly 100 apart from existing strap assemblies.

Where object 101 is a pair of goggles, the rotational capability allows the goggles to fit better and more comfortably, both when worn alone or with a helmet, than would be possible if strap 110 were permanently fixed in a single position or orientation. In that regard, goggles lacking the rotational capability of strap assembly 100 are forced to lie straight back from the goggle around the back of the head and tend to dig uncomfortably into the face or head of the wearer. Variations in individual wearing preference, as well as the wide variety of individual head size and shape, call for a rotatable strap assembly so that such discomfort can be avoided. Similar comments apply to backpacks, briefcases, and other objects having straps.

Referring to FIGS. 1 and 2, hinge 121 connects cover 210 and base 220 to each other. Hinge 121 may be a hinge of any kind; however, in the illustrated embodiment, hinge 121 is a living hinge, which is a thin, flexible web of material that joins two bodies together. As is known in the art, it is possible to create a living hinge that is capable of flexing many thousands of times before failing. Living hinges are also economical because they may be molded in the same process that forms the parts connected by the living hinge and because they do not use much material.

Figure 3:
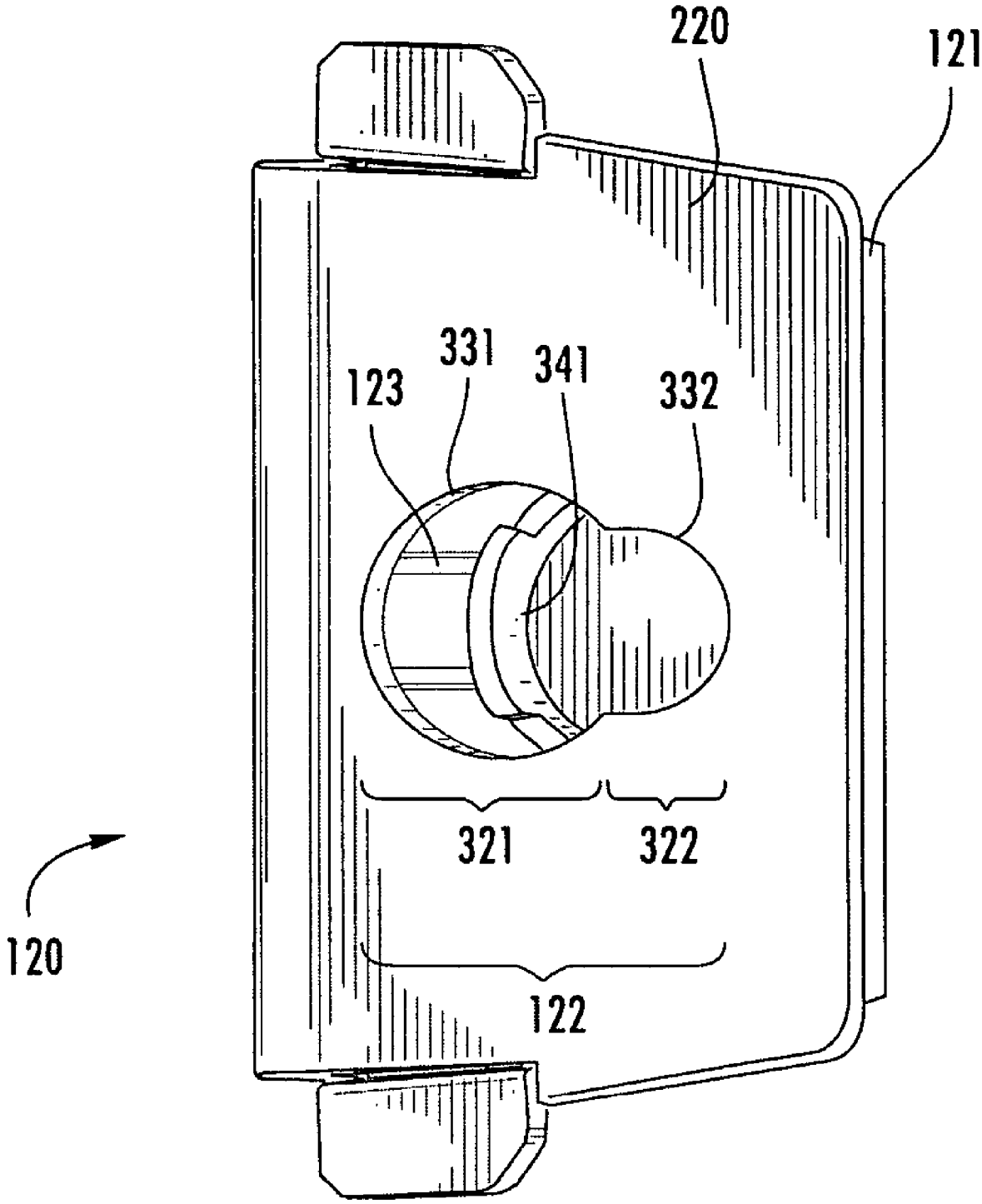
FIG. 3 is a bottom view of the buckle of FIG. 2 in a closed configuration according to an embodiment of the invention.

FIG. 3 is a bottom view of buckle 120 according to an embodiment of the invention. As illustrated in FIG. 3, a portion of locking extension 123 extends into engagement aperture 122 when cover 210 (see FIG. 2) is closed over base 220. Engagement aperture 122 comprises a circular portion 321 having a perimeter 331 and further comprises an oval or elliptical portion 322 having a perimeter 332. Recalling that post 141 has a first diameter and cap 142 has a second diameter, circular portion 321 has a third diameter and elliptical portion 322 has a fourth diameter.

The first diameter is smaller than the second, third, and fourth diameters. The third diameter is larger than the second and fourth diameters. The second diameter is larger than the fourth diameter. In other words, the diameter of post 141 (the first diameter) is smaller than the diameters of cap 142, circular portion 321, and elliptical portion 322. Further, the diameter of circular portion 321 (the third diameter) is larger than the diameters of cap 142 and elliptical portion 322. Finally, the diameter of cap 142 (the second diameter) is larger than the diameter of elliptical portion 322. The stated configuration, in one embodiment, permits cap 142 to pass through circular portion 321 (the larger portion of engagement aperture 122) but not through elliptical portion 322.

As illustrated, circular portion 321 and elliptical portion 322 communicate with each other, meaning circular portion 321 and elliptical portion 322 merge together to form the depicted keyhole shape. Because circular portion 321 and elliptical portion 322 merge together, neither circular portion 321 nor elliptical portion 322 forms a complete circle or ellipse. Furthermore, one or both of circular portion 321 and elliptical portion 322 might have a shape other than circular or elliptical. The phrases "circular portion" and "elliptical portion," as used herein, encompass the entire range of apertures, whether circular, elliptical, triangular, rectangular, hexagonal or otherwise, that may be used as engagement aperture 122.

In one embodiment, when cover 210 (FIG. 2) is closed over base 220, a portion of locking extension 123 extends into circular portion 321 of engagement aperture 122, and cap 142 (see FIG. 1) is trapped between the perimeter 332 and a curved section 341 of locking extension 123. Recall from above that cap 142, in one embodiment, is unable to pass through elliptical portion 322. In that embodiment, closing cover 210 over base 220, thereby placing the portion of locking extension 123 into circular portion 321, is equivalent to locking buckle 120 onto attachment piece 102. In the same embodiment, cover 210 must be lifted away from base 220 before attachment piece 102 may be slid from elliptical portion 322 to circular portion 321 and removed from circular portion 321 and, thus, from buckle 120.

Referring again to FIG. 2, cover 210 comprises a tab 241 having a proximal end 244 and a distal end 245. Cover 210 further comprises a tab 242 at an opposite side of cover 210 from tab 241. Tab 242 has a proximal end 248 and a distal end 249. In the illustrated embodiment, tab 241 rests in an undercut 271 located in base 220 when cover 210 is closed over base 220. Similarly, tab 242 rests in an undercut 272 located in base 220 when cover 210 is closed over base 220.

Tab 241 has a detent 251 at proximal end 244, and, although it is not visible in FIG. 2, tab 242 has a similar detent at proximal end 248. In this discussion, the phrase "detent 251" will be used to indicate both the visible detent and the non-visible detent. A function of detent 251 and of tabs 241 and 242 will be discussed below.

Base 220 comprises an overhang 261 having an underside 262. Although it is not visible in FIG. 2, a similar overhang having a similar underside is located on base 220 opposite overhang 261. In this discussion, the phrase "overhang 261" and the phrase "underside 262" will be used to indicate, respectively, both the visible and non-visible overhang and both the visible and the non-visible underside. Detent 251 engages underside 262 of overhang 261 when cover 210 is closed over base 220. In order to lift cover 210, detent 251 must be moved to clear overhang 261. In one embodiment, this is done by lifting tabs 241 and 242 and causing them to flex outward and upward away from base 220, thereby swinging detent 251 out away from overhang 261 and releasing cover 210 from base 220.

Referring still to FIG. 2, base 220 further comprises a back 280 and a foot 290 extending from back 280 at an angle 285. Back 280 contains engagement aperture 122 and foot 290 contains slot 221. In the illustrated embodiment, angle 285 is greater than ninety degrees, which allows a portion of strap 110 to overlie cover 210 in a manner and for a purpose that will be further explained below. Further in the illustrated embodiment, hinge 121 is located at an end of back 280 opposite foot 290. An advantage of such an arrangement will also be explained below.

Engagement aperture 122 has a long axis 227 and a short axis 228 that is substantially perpendicular to long axis 227. In the illustrated embodiment, engagement aperture 122 is oriented horizontally, which is to say that long axis 227 is substantially perpendicular to slot 221. With engagement aperture 122 oriented horizontally, tension on strap 110 (see FIG. 1) tends to force attachment piece 102 (FIG. 1) into elliptical portion 322 (FIG. 3) so as to lock buckle 120 in place on object 101 (FIG. 1). In other words, the horizontal orientation helps strap assembly 100 to remain attached to object 101 (See FIG. 1) even if hinge 121 fails, does not lock into base 220, or if a portion of locking extension 123 does not extend into circular portion 321.

In a non-illustrated embodiment, engagement aperture 122 is oriented vertically, meaning long axis 227 and short axis 228, and, thus, engagement aperture 122, are rotated ninety degrees in either direction. A vertical orientation of engagement aperture 122 enables base 220 to have a back 280 that is smaller, and thus less expensive, than back 280 needs to be in the horizontal embodiment discussed above. More particularly, the length of back 280 may be decreased. The vertical embodiment, however, does not possess the advantages that were mentioned above as being possessed by the horizontal embodiment.

Referring again to the embodiment illustrated in FIG. 2, buckle 120 is symmetric about an axis collinear with long axis 227 of engagement aperture 122. Such symmetry allows buckle 120 to be used interchangeably at end 111 and end 112 of strap 110 and also interchangeably with the attachment pieces, including attachment piece 102, of object 101 (see FIG. 1).

Figure 4:
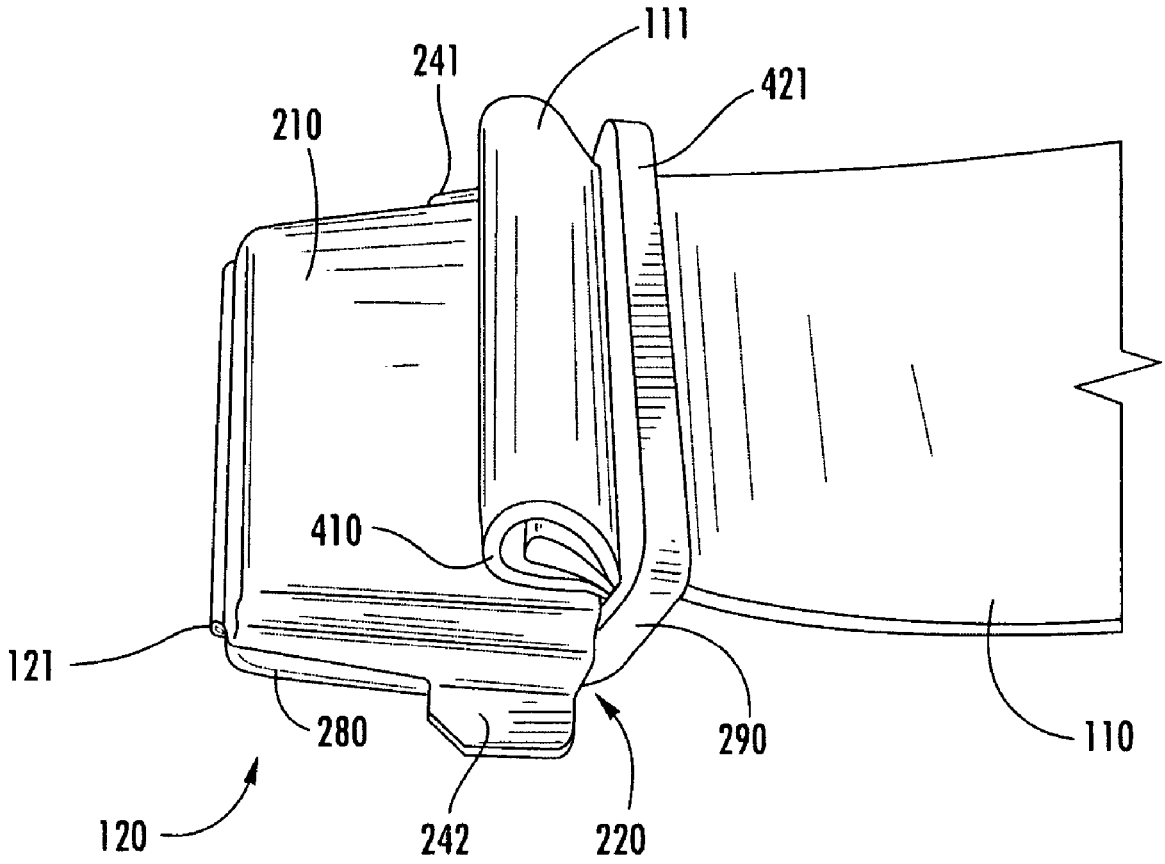
FIG. 4 is a perspective view of a buckle in a closed configuration and a portion of a strap according to an embodiment of the invention.

FIG. 4 is a perspective view of buckle 120 and a portion of strap 110 according to an embodiment of the invention. As illustrated in FIG. 4, end 111 of strap 110 is turned back on and joined to itself to create a loop 410. A tip of strap 110 is folded inside loop 410, and loop 410 can be sewn, stitched, and/or glued together. As shown, loop 410 does not enclose any portion of buckle 120, but is large enough that it may not easily be pulled through slot 221 (See FIG. 2). In one embodiment, loop 410 may only be pulled through slot 221 upon the application of 100 to 150 pounds of force to strap 110. In other embodiments, loop 410 may be made to slip through slot 221 upon the application of a force of greater or lesser magnitude. If a force equaling or exceeding the pre-determined magnitude is applied to strap 110, loop 410 may be pulled through slot 221 without damaging buckle 120 (because buckle 120 is slightly flexible). In the absence of a force of such magnitude, strap 110 remains attached to buckle 120. In a non-illustrated embodiment, loop 410 encloses a portion 421 of foot 290, and loop 410 is therefore permanently attached to buckle 120 as long as strap 110 and loop 410 remain intact. In one manifestation of this non-illustrated embodiment, only one of loop 410 and its counterpart at buckle 190 (FIG. 1) encloses a portion of foot 290 or its counterpart on buckle 190, while the other loop of strap 110 does not enclose any portion of its corresponding buckle 120. In another manifestation, both loops enclose a portion of a buckle, while in a third manifestation, neither loop encloses any portion of a buckle.

It was mentioned above that locating hinge 121 at an end of back 280 opposite foot 290 offers a certain advantage. FIG. 4 offers an illustration of that advantage, which is that loop 410 biases cover 210 toward base 220 when cover 210 is closed over base 220. Such biasing is a result of the fact that loop 410 naturally extends over a portion of cover 210 and forces it toward base 220. A value for angle 285 (see FIG. 2) greater than 90 degrees also allows loop 410 to naturally fall to the illustrated position. With loop 410 biasing cover 210 toward base 220, buckle 120 is kept in secure engagement with attachment piece 102 (See FIG. 1), for the reasons explained above.

Buckle 120 may be formed from an impact modified polypropylene, a polyolefin, a thermoplastic urethane, or the like. Impact modified polypropylene is a preferred material from which to construct a living hinge, and it is durable and impact resistant, as are the other materials listed.

Figure 5:
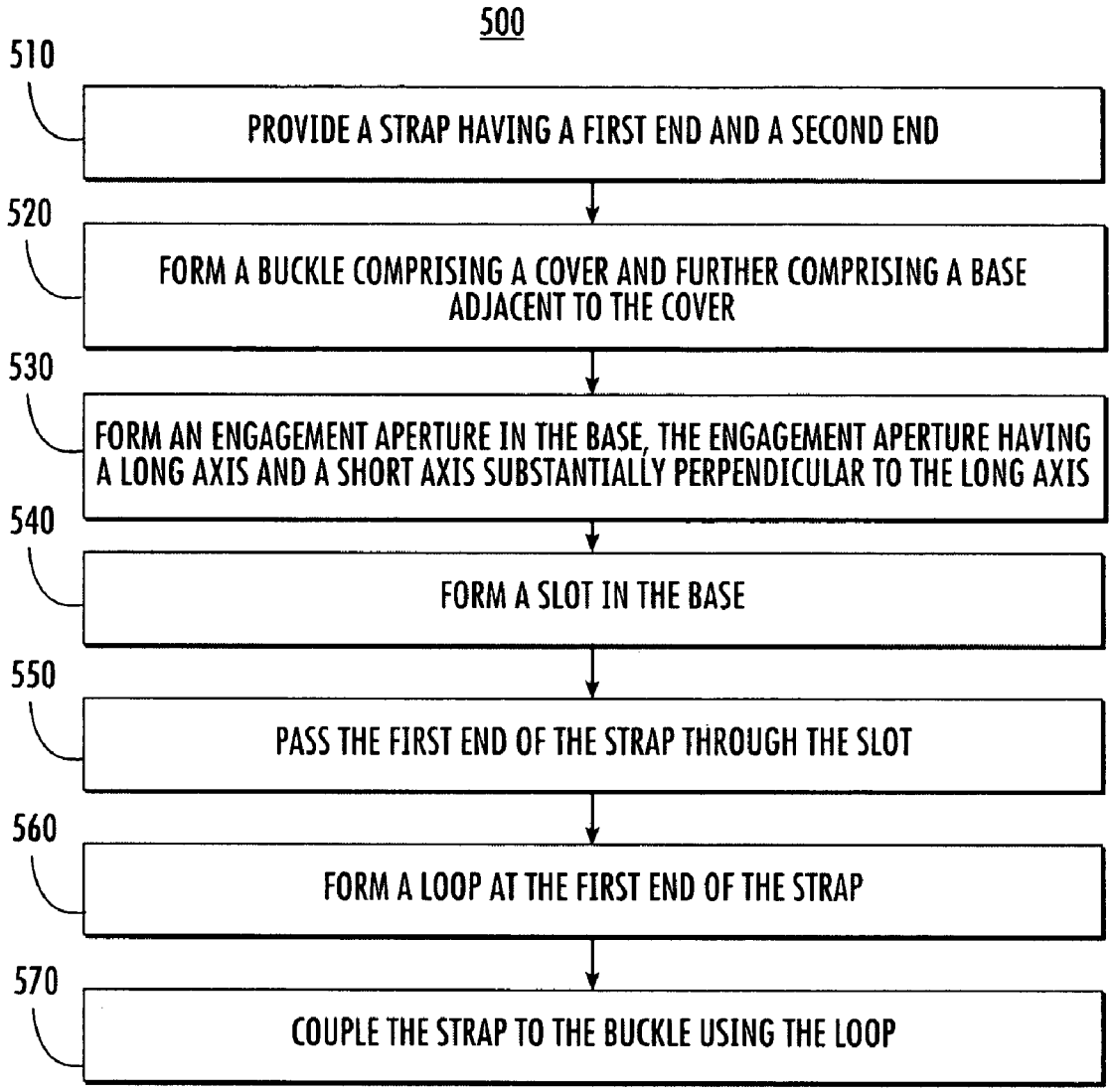
FIG. 5 is a flowchart illustrating a method of manufacturing a strap assembly according to an embodiment of the invention.

FIG. 5 is a flowchart illustrating a method 500 of manufacturing a strap assembly capable of removable and rotational engagement with an object, where the object has an attachment piece coupled thereto and the attachment piece comprises a post having a first diameter and a cap having a second diameter larger than the first diameter.

A step 510 of method 500 is to provide a strap having a first end and a second end. As an example, the strap can be similar to strap 110, and the first end and the second end can be similar to, respectively, ends 111 and 112, all of which were first shown in FIG. 1.

A step 520 of method 500 is to form a buckle comprising a cover and further comprising a base adjacent to the cover. In one embodiment, the buckle is formed of a single material in an injection molding process. In other embodiments, multiple-stage injection molding may be used in connection with a buckle made of more than one material. As an example, the buckle can be similar to buckle 120, and the cover and the base can be similar to, respectively, cover 210 and base 220. Buckle 120, cover 210, and base 220 were first shown in FIG. 1. Cover 210 and base 220 were first described in connection with FIG. 2.

In one embodiment, step 520 comprises forming a hinge connecting the cover and the base. As an example, the hinge can be similar to hinge 121, first shown in FIG. 1. In the same or another embodiment, step 520 comprises forming a locking extension on the cover that extends away from the cover. As an example, the locking extension can be similar to locking extension 123, first shown in FIG. 3. In the same or another embodiment, step 520 comprises one or more of: forming a tab on the cover; forming an overhang on the base; and forming a detent at the proximal end of the tab. As an example, the tab, the overhang, and the detent can be similar to, respectively, tabs 241, overhang 261, and detent 251, all of which were first shown in FIG. 2. In the same or another embodiment, step 520 comprises forming the base to include a back and a foot extending from the back. As an example, the foot may extend from the back at an angle greater than ninety degrees. As another example, the back and the foot can be similar to, respectively, back 280 and foot 290, both of which were first shown in FIG. 2.

A step 530 of method 500 is to form an engagement aperture in the base, the engagement aperture having a long axis and a short axis substantially perpendicular to the long axis. As an example, the engagement aperture can be similar to engagement aperture 122, first shown in FIG. 1. The long axis and the short axis can be similar to, respectively, long axis 227 and short axis 228, first shown in FIG. 2. In one embodiment, step 520, step 530, or another step comprises forming the buckle to be symmetric about an axis collinear with the long axis of the engagement aperture.

In one embodiment, step 530 comprises forming a circular portion and an elliptical portion in the base. As an example, the circular portion and the elliptical portion can be similar to, respectively, circular portion 321 and elliptical portion 322.

A step 540 of method 500 is to form a slot in the base. As an example, the slot can be similar to slot 221, first shown in FIG. 2. In a different embodiment, steps 520, 530, and 540 are performed simultaneously with each other.

A step 550 of method 500 is to pass the first end of the strap through the slot, and a step 560 of method 500 is to form a loop at the first end of the strap. As an example, the loop can be similar to loop 410, first shown in FIG. 4.

A step 570 of method 500 is to couple the strap to the buckle using the loop. As an example, step 570 may entail coupling the strap to the buckle a manner described above. In a different embodiment, steps 560 and 570 are performed simultaneously with each other.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the strap assembly discussed herein may be implemented in a variety of embodiments, and that the foregoing discussion of certain of these embodiments does not necessarily represent a complete description of all possible embodiments.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A strap assembly capable of engagement with an object having an attachment piece coupled thereto, the strap assembly comprising:

a strap having a first end and a second end; and a buckle coupled to the strap, wherein:

the buckle comprises:

a cover; and a base adjacent to the cover;

the base comprises:

a slot; and an engagement aperture;

the strap extends through the slot;

the first end of the strap is turned back on and joined to itself to create a loop;

the loop does not enclose any portion of the buckle;

the loop may be pulled through the slot without damaging the buckle upon application of a pre-determined amount of force to the strap;

the engagement aperture is capable of engaging the attachment piece; and the buckle is capable of rotating about the attachment piece when the engagement aperture is engaged with the attachment piece.

2. The strap assembly of claim 1 wherein:

the buckle is capable of rotating through 360 degrees about a first axis substantially parallel to a portion of the attachment piece.

3. The strap assembly of claim 2 wherein:

the buckle is capable of rotating about a second axis substantially perpendicular to the first axis.

4. The strap assembly of claim 1 wherein:

the buckle further comprises a hinge;

the hinge connects the cover and the base to each other; and the hinge is located at an opposite end of the base from the slot.

5. The strap assembly of claim 4 wherein:

the hinge is a living hinge.

6. The strap assembly of claim 1 wherein:

the cover comprises a locking extension that extends away from the cover and toward the base when the cover is closed over the base; and a portion of the locking extension extends into the engagement aperture when the cover is closed over the base.

7. The strap assembly of claim 6 wherein:

the engagement aperture comprises:

a first portion having a first perimeter and a first diameter; and a second portion having a second perimeter and a second diameter smaller than the first diameter;

the first portion and the second portion communicate with each other;

the portion of the locking extension extends into the first portion of the engagement aperture when the cover is closed over the base; and the attachment piece is located between the second perimeter and the locking extension when the cover is closed over the base.

8. The strap assembly of claim 1 wherein:

the cover comprises a tab having a proximal end and a distal end;

the base comprises an overhang having an underside;

the tab has a detent at the proximal end; and the detent engages the underside of the overhang when the cover is closed over the base.

9. The strap assembly of claim 1 wherein:
the base further comprises a back and a foot extending from the back at an angle greater than ninety degrees;
the back contains the engagement aperture; and
the fool contains the slot.

10. The strap assembly of claim 9 wherein:
the buckle further comprises a hinge;
the hinge connects the cover and the base to each other;
the back has a first end and a second end opposite the first end; and
the hinge is at the first end and the foot is at the second end.

11. The strap assembly of claim 1 wherein:
the engagement aperture has a long axis and a short axis substantially perpendicular to the long axis; and
the long axis is substantially perpendicular to the slot.

12. The strap assembly of claim 11 wherein:
the buckle is symmetric about an axis collinear with the long axis of the engagement aperture.

13. The strap assembly of claim 1 wherein:
the loop biases the cover toward the base when the cover is closed over the base.

14. A strap assembly capable of removable and rotational engagement with an object having first and second attachment pieces coupled thereto, the strap assembly comprising:
an elastic strap having a first end and a second end;
a first buckle removably coupled to the first end of the elastic strap; and
a second buckle removably coupled to the second end of the elastic strap, wherein:
the first buckle comprises a first cover and a first base hingedly connected to each other with a first living hinge;
the second buckle comprises a second cover and a second base hingedly connected to each other with a second living hinge;
the first base comprises a first slot and a first engagement aperture;
the second base comprises a second slot and a second engagement aperture;
the elastic strap extends through the first slot and the second slot;
the first end of the elastic strap extends through the first slot and is turned back on and joined to itself to create a first loop;
the first loop does not enclose any portion of the first buckle;
the first loop may be pulled through the first slot without damaging the first buckle upon a application of a re-determined amount of force to the elastic strap;
the first engagement aperture is capable of engaging the first attachment piece such that the first buckle is rotatable about the first attachment piece; and
the second engagement aperture is capable of engaging the second attachment piece such that the second buckle is rotatable about the second attachment piece.

15. The strap assembly of claim 14 wherein:
the first buckle is rotatable through 360 degrees about the first attachment piece; and
the second buckle is rotatable through 360 degrees about the second attachment piece.

16. The strap assembly of claim 15 wherein:
the first buckle and the second buckle are symmetric and interchangeable with each other.

17. The strap assembly of claim 15 wherein:
the first engagement aperture comprises:
a first circular portion having a first perimeter and a first diameter; and
a first elliptical portion having a second perimeter and a second diameter;
the second engagement aperture comprises:
a second circular portion having a third perimeter and the first diameter; and
a second elliptical portion having a fourth perimeter and the second diameter;
the first attachment piece comprises:
a first post having a third diameter; and
a first cap having a fourth diameter;
the second attachment piece comprises:
a second post having the third diameter; and
a second cap having the fourth diameter;
the first diameter is larger than the second, third, and fourth diameters;
the fourth diameter is larger than the second and third diameters; and
the third diameter is smaller than the second diameter.

18. The strap assembly of claim 17 wherein:
the first engagement aperture has a first long axis and a first short axis substantially perpendicular to the first long axis;
the second engagement aperture has a second long axis and a second short axis substantially perpendicular to the second long axis;
the first long axis is substantially perpendicular to the first slot; and
the second long axis is substantially perpendicular to the second slot.

19. The strap assembly of claim 18 wherein:
the first buckle is symmetric about an axis collinear with the first long axis; and
the second buckle is symmetric about an axis collinear with the second long axis.

20. The strap assembly of claim 17 wherein:
the first cap and the second cap are substantially flat.

21. The strap assembly of claim 17 wherein:
the first cap and the second cap are spherical.

22. The strap assembly of comprises 15 wherein:
the first base further comprises a first back and a first foot extending from the first back at an angle greater than ninety degrees;
the second base further comprises a second back and a second foot extending from the second back at an angle greater than ninety degrees;
the first back contains the first engagement aperture;
the second back contains the second engagement aperture;
the first foot contains the first slot; and
the second foot contains the second slot.

23. The strap assembly of claim 14 wherein:
the second end of the elastic strap extends through the second slot and is turned back on and joined to itself to create a second loop;
the second loop does not enclose any portion of the second buckle; and
the second loop may be pulled through the second slot without damaging the second buckle upon application of a pre-determined amount of force to the elastic strap.

24. A goggle comprising:
a facemask portion having an attachment piece coupled thereto; and
a strap assembly capable of engagement with the attachment piece, wherein:

the strap assembly comprises:

a strap having a first end and a second end; and a buckle coupled to the strap;

the buckle comprises:

a cover; and a base adjacent to the cover;

the base comprises:

a slot; and an engagement aperture;

the strap extends through the slot;

the first end of the strap is turned back on and joined to itself to create a loop;

the loop does not enclose any portion of the buckle; the loop may be pulled through the slot without damaging the buckle upon application of a pre-determined amount of force to the strap;

the engagement aperture is capable of engaging the attachment piece; and the buckle is capable of rotating about the attachment piece when the engagement aperture is engaged with the attachment piece.

* * * * *